US009101167B2

(12) United States Patent
Fath

(10) Patent No.: US 9,101,167 B2
(45) Date of Patent: Aug. 11, 2015

(54) DISPLAY CARTON AND SYSTEM FOR DISPLAYING A PLURALITY OF CONTAINERS

(71) Applicant: Altria Client Services Inc., Richmond, VA (US)

(72) Inventor: Scott A. Fath, Richmond, VA (US)

(73) Assignee: ALTRIA CLIENT SERVICES INC., Richmond, VA (US)

( * ) Notice: Subject to any disclaimer, the term of this patent is extended or adjusted under 35 U.S.C. 154(b) by 21 days.

(21) Appl. No.: 13/902,017

(22) Filed: May 24, 2013

(65) Prior Publication Data

US 2013/0334096 A1 Dec. 19, 2013

Related U.S. Application Data

(60) Provisional application No. 61/651,442, filed on May 24, 2012.

(51) Int. Cl.
*A24F 23/00* (2006.01)
*B65D 71/72* (2006.01)
(Continued)

(52) U.S. Cl.
CPC ..... *A24F 23/00* (2013.01); *A47F 7/283* (2013.01); *B65D 5/5007* (2013.01); *B65D 5/52* (2013.01); *B65D 5/542* (2013.01); *B65D 5/5445* (2013.01); *B65D 71/36* (2013.01); *B65D 71/72* (2013.01);
(Continued)

(58) Field of Classification Search
CPC ..... A24F 23/00; A47F 5/0846; A47F 7/283; B65D 5/5007; B65D 5/52; B65D 5/542; B65D 5/5445; B65D 71/36; B65D 71/72; B65D 2571/00222; B65D 2571/0029; B65D 2571/00314; B65D 2571/00574; B65D 2571/0066; B65D 2571/00753
USPC ..... 206/443, 485, 763, 765; 229/120.18, 229/120.21; 211/70.1
See application file for complete search history.

(56) References Cited

U.S. PATENT DOCUMENTS 1,966,734 A * 7/1934 Rosen ..... 211/70.1
2,774,475 A 12/1956 Morken
(Continued)

FOREIGN PATENT DOCUMENTS

WO 2011100833 A1 8/2011

OTHER PUBLICATIONS

International Search report of International Application No. PCT/US2013/042610 dated Aug. 14, 2013.

*Primary Examiner* — Bryon Gehman
(74) *Attorney, Agent, or Firm* — Roberts Mlotkowski Safran & Cole, P.C.

(57) ABSTRACT

A display carton for displaying a plurality of containers. The display carton includes a base having a front edge, and a back edge, a front side member extending perpendicularly from the front edge of the base and terminating at an upper edge thereof, a rear side member extending perpendicularly from the rear edge of the base and terminating at an upper edge thereof, the rear side member having a cover panel detachably affixed to the rear side member; an upper tray member having a front edge, and a back edge, the front edge extending perpendicularly from the upper edge of the front side member, the upper tray member having a plurality of first apertures; and a lower tray member, the lower tray member positioned along a plane substantially parallel to the upper tray member and the base and located therebetween, the lower tray member having a plurality of second apertures.

14 Claims, 10 Drawing Sheets

(51) Int. Cl.

| | |
|---|---|
| ***B65D 5/52*** | (2006.01) |
| ***B65D 71/36*** | (2006.01) |
| ***B65D 5/50*** | (2006.01) |
| ***B65D 5/54*** | (2006.01) |
| ***A47F 7/28*** | (2006.01) |
| *A47F 5/08* | (2006.01) |

(52) U.S. Cl.

CPC ..... *A47F 5/0846* (2013.01); *B65D 2571/0029* (2013.01); *B65D 2571/0066* (2013.01); *B65D 2571/00222* (2013.01); *B65D 2571/00314* (2013.01); *B65D 2571/00574* (2013.01); *B65D 2571/00753* (2013.01)

(56) References Cited

U.S. PATENT DOCUMENTS

| | | | | | |
|---|---|---|---|---|---|
| 2,833,457 | A | * | 5/1958 | Tyrseck | 206/763 |
| 3,115,247 | A | * | 12/1963 | Hauser | 206/485 |
| 3,490,582 | A | | 1/1970 | Farquhar | |
| 3,682,597 | A | * | 8/1972 | Husch | 206/485 |
| D227,551 | S | | 7/1973 | Bryant | |
| 3,921,895 | A | * | 11/1975 | Ziche | 206/486 |
| 3,987,892 | A | * | 10/1976 | Killy | 206/443 |
| D252,072 | S | | 6/1979 | Bridges | |
| D264,810 | S | | 6/1982 | Voltmann | |
| D273,179 | S | | 3/1984 | Shore | |
| 4,434,890 | A | * | 3/1984 | Sieck et al. | 206/443 |
| D311,115 | S | | 10/1990 | Abraham | |
| D330,513 | S | | 10/1992 | Gilchrist | |
| D351,787 | S | | 10/1994 | Hansen | |
| D362,515 | S | | 9/1995 | Pickett | |
| 5,722,584 | A | * | 3/1998 | Fujiwara | 229/120.18 |
| D393,418 | S | | 4/1998 | Doan et al. | |
| 5,829,587 | A | * | 11/1998 | Saiki et al. | 206/485 |
| 5,871,145 | A | * | 2/1999 | Hermann et al. | 229/120.21 |
| D426,461 | S | | 6/2000 | Noble | |
| 6,081,326 | A | | 6/2000 | Rousseau et al. | |
| D433,939 | S | | 11/2000 | Humphrey | |
| D438,816 | S | | 3/2001 | Madden, IV | |
| D504,550 | S | | 4/2005 | Setcer, Jr. | |
| D515,943 | S | | 2/2006 | Hamblin et al. | |
| 7,028,839 | B2 | * | 4/2006 | Belloli et al. | 206/443 |
| D538,538 | S | | 3/2007 | Espinosa | |
| D551,038 | S | | 9/2007 | Evaimalo et al. | |
| D554,280 | S | | 10/2007 | Chen | |
| D568,732 | S | | 5/2008 | Kovac | |
| D608,609 | S | | 1/2010 | Eaton | |
| 7,987,983 | B1 | | 8/2011 | Guitreau | |
| D650,636 | S | | 12/2011 | Roth | |
| 2007/0151973 | A1 | | 7/2007 | Wang | |

* cited by examiner

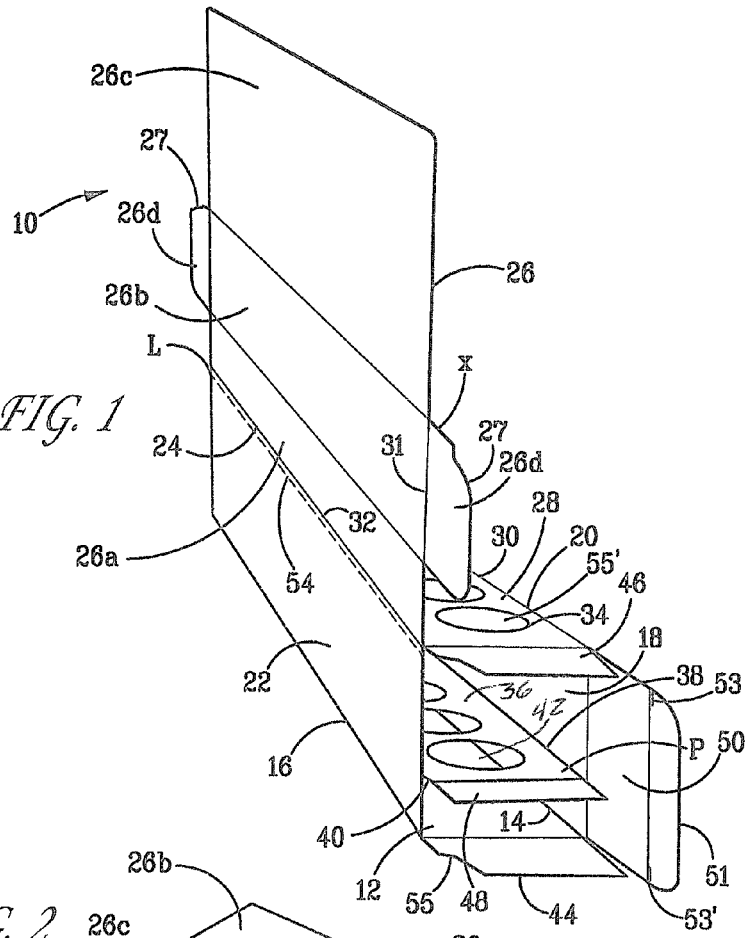
FIG. 1
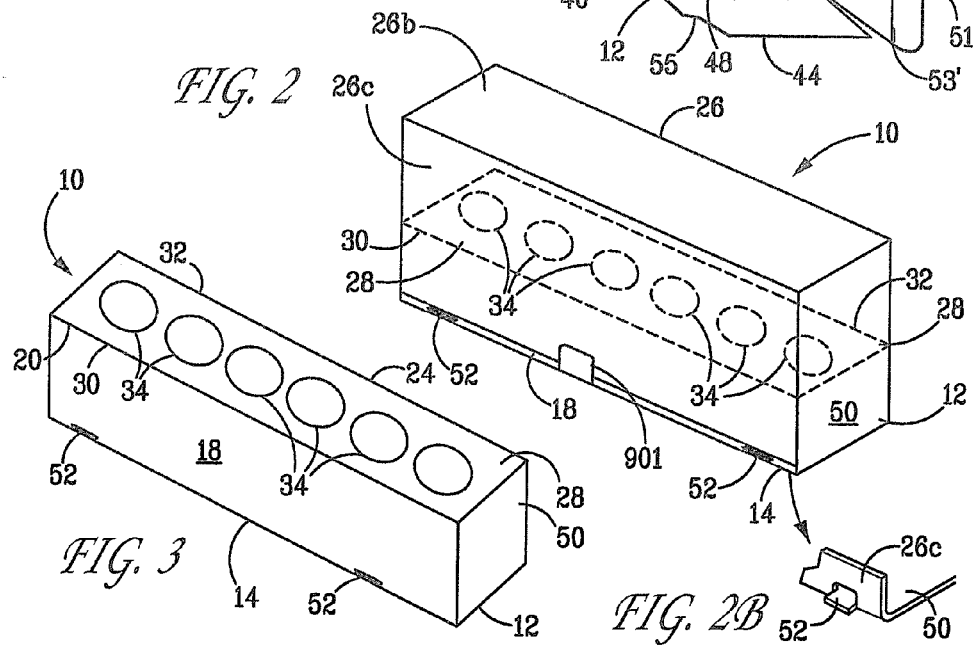
FIG. 2
FIG. 3
FIG. 2B

DISPLAY CARTON AND SYSTEM FOR DISPLAYING A PLURALITY OF CONTAINERS

RELATED APPLICATION

This patent application claims priority to Provisional Application Ser. No. 61/651,442 filed on May 24, 2012, which is hereby incorporated by reference in its entirety.

FIELD

This document relates generally to packaging for use with a plurality of containers and, more particularly, to packaging for use in the point-of-sale (POS) display of consumer products, such as smokeless tobacco products.

WORKING ENVIRONMENT

Recently, new forms of smokeless tobacco products have entered the market place or have been described, including products in the form of gels, films and tablets. Designing packaging for use with a smokeless tobacco product in the form of a tablet provides unique challenges. For example, with tobacco-based products, moisture content can become an issue, since tobacco is, by its nature, hygroscopic. Child-resistance is also another desirable property for packaging used with a smokeless tobacco product.

In the packaging of tablets for distribution to consumers, blister packs are frequently utilized. Larger format tablets may be packaged in tubular containers, as often found in pharmaceutical and medical products. A stack of large format tablets tend to survive the rigors of shipping, since the tablets are not free to randomly collide with one another through product jostling during transit.

Despite the advances in the art, there remains a need for improved display cartons and systems for use with large format tablets packaged in containers that contain a plurality of tablets, such as smokeless tobacco products and for methods of making and displaying such packaging.

SUMMARY

Disclosed herein are display cartons for use with a plurality of containers, point-of-sale systems employing same and methods for making display cartons and systems.

In one aspect, provided is a display carton for displaying a plurality of containers. The display carton includes a base having a front edge, and a back edge, a front side member extending perpendicularly from the front edge of the base and terminating at an upper edge thereof, a rear side member extending perpendicularly from the rear edge of the base and terminating at an upper edge thereof, the rear side member having a cover panel detachably affixed to the rear side member; an upper tray member having a front edge, and a back edge, the front edge extending perpendicularly from the upper edge of the front side member, the upper tray member having a plurality of first apertures; and a lower tray member, the lower tray member positioned along a plane substantially parallel to the upper tray member and the base and located therebetween, the lower tray member having a plurality of second apertures, each of the plurality of second apertures in axial alignment with a corresponding first aperture of the plurality of first apertures; wherein the detachable cover panel is configured to fold over and enclose the plurality of containers when inserted through corresponding first and second apertures and cover at least a portion of the front side member for sealing the detachable cover panel thereto.

In one form, each end of the base and each end of the upper tray member have foldable end flaps.

In another form, each end of the front side member has foldable end flaps for engaging with the foldable end flaps of the base and the upper tray member for closure of the display carton, each the foldable end flap of the front side member serving to form an end member.

In yet another form, each of the plurality of containers are positioned within a first aperture of the plurality of first apertures of the upper tray member and a corresponding second aperture of the plurality of second apertures of the lower tray member.

In still yet another form, the plurality of first apertures of the upper tray member and the plurality of second apertures of the lower tray member are arranged in at least two rows.

In a further form, the plurality of first apertures of the upper tray member and the plurality of second apertures of the lower tray member are substantially circular.

In a still further form, the front side member includes a pair of retention cuts adjacent the front edge of the base, the pair of retention cuts effective to aid in the registration of the detachable cover panel.

In a still yet further form, the detachable cover panel includes a set of perforations to permit detachment, the set of perforations extending along a line positioned below the upper edge of rear side member.

In another aspect, provided is a system for displaying a plurality of containers in cooperation with a point of sale display rack. The system includes: a display carton for displaying a plurality of containers, the display carton including a base having a front edge, and a back edge; a front side member extending perpendicularly from the front edge of the base and terminating at an upper edge thereof; a rear side member extending perpendicularly from the rear edge of the base and terminating at an upper edge thereof, the rear side member having a cover panel detachably affixed to the rear side member; an upper tray member having a front edge, and a back edge, the front edge extending perpendicularly from the upper edge of the front side member, the upper tray member having a plurality of first apertures; and a lower tray member, the lower tray member positioned along a plane substantially parallel to the upper tray member and the base and located therebetween, the lower tray member having a plurality of second apertures, each of the plurality of second apertures in axial alignment with a corresponding first aperture of the plurality of first apertures; wherein the detachable cover panel is configured to fold over and enclose the plurality of containers when inserted through corresponding first and second apertures and cover at least a portion of the front side member for sealing the detachable cover panel thereto; and an elongated support rail comprising a bottom rail portion for supporting the base of the display carton, the bottom rail portion having a front edge and a rear edge, and a back rail portion for supporting the rear side member of the display carton, the back rail portion having a lower edge integrally formed and adjacent to the rear edge of the bottom rail portion.

In one form, the front side member of the display carton includes a pair of retention cuts adjacent the front edge of the base, the pair of retention cuts effective to aid in the registration of the detachable cover panel.

In another form, the front edge of the bottom rail portion of the elongated support rail terminates in an upwardly extending lip for engaging the pair of retention cuts of the front side member of the display carton, wherein the distance between the upwardly extending lip and the back rail portion of the elongated support rail is selected to securely retain the display carton when the pair of retention cuts of the front side member of the display carton are engaged with upwardly extending lip.

In yet another form, the system includes a point-of-sale message board having a front side for displaying a message thereon and a rear side, the message board having an upper edge terminating in a downwardly extending and rear-side-facing retaining flange, and a lower edge terminating in an upwardly extending and front-side-facing locking member.

In still yet another form, the rear-side-facing retaining flange is configured to securely attach to a horizontal member of the point of sale display rack.

In a further form, the rear-side-facing retaining flange is hingedly mounted to the upper edge of the message board.

In a still further form, the elongated support rail further includes a channel for receiving the front-side-facing locking member of the point-of-sale message board.

In a still yet further form, the detachable cover panel includes a set of perforations to permit detachment, the set of perforations extending along a line positioned below the upper edge of rear side member.

In one form, the detachable cover panel includes a set of perforations to permit detachment, the set of perforations extending along a line positioned below the upper edge of rear side member.

In another form, each of the plurality of containers are positioned within a first aperture of the plurality of first apertures of the upper tray member and a corresponding second aperture of the plurality of second apertures of the lower tray member.

In yet another aspect, provided is a method of forming a display carton from a sheet of stock. The method includes the steps of cutting the sheet of stock into a size and shape sufficient to form a substrate having a plurality of panels; folding the substrate to form a display carton for displaying a plurality of containers, the display carton including a base having a front edge, and a back edge; a front side member extending perpendicularly from the front edge of the base and terminating at an upper edge thereof; a rear side member extending perpendicularly from the rear edge of the base and terminating at an upper edge thereof, the rear side member having a cover panel detachably affixed to the rear side member; an upper tray member having a front edge, and a back edge, the front edge extending perpendicularly from the upper edge of the front side member; and a lower tray member, the lower tray member positioned along a plane substantially parallel to the upper tray member and the base and located therebetween, the lower tray member having a plurality of second apertures, each of the plurality of second apertures in axial alignment with a corresponding first aperture of the plurality of first apertures; adhesively securing a front edge flap of the lower tray member to an inner side of the front side member; wherein the detachable cover panel is configured to fold over and enclose the plurality of containers when inserted through corresponding first and second apertures and cover at least a portion of the front side member for sealing the detachable cover panel thereto.

In one form, the method also includes the step of forming a plurality of first apertures in the upper tray member and a set of second apertures in the lower tray member, the first apertures being at least substantially aligned with the second apertures.

In another form, the plurality of first apertures of the upper tray member and the plurality of second apertures of the lower tray member are arranged in at least two rows.

In yet another form, each end of the base and each end of the upper tray member have foldable end flaps.

In still yet another form, each end of the front side member has foldable end flaps for engaging with the foldable end flaps of the base and the upper tray member for closure of the display carton, each the foldable end flap of the front side member serving to form an end member.

In still yet another aspect, provided is a method of presenting containers of product for sale. The method includes the steps of sending the containers to a place of sale by arranging the containers in a paperboard tray and protecting the containers with paperboard panels folded about the tray; removing the removable panels at the place of sale and positioning the tray on a rail of a display fixture, the positioning including retaining the tray in place on the rail by bearing a retention cut of the tray with a surface portion of the rail.

These and other features will be apparent from the detailed description taken with reference to the accompanying drawings.

BRIEF DESCRIPTION OF THE DRAWINGS

Further explanation may be achieved by reference to the description that follows and the drawings illustrating, by way of non-limiting examples, various forms, wherein:

FIG. 1 is a perspective view of a partially formed display carton, showing interior details, in accordance herewith;

FIG. 2 is a perspective view of a display carton, with detachable cover panel in a closed position for shipping, in accordance herewith;

FIG. 2B is an enlarged perspective view of a lower front corner of the display carton of FIG. 2;

FIG. 3 is a perspective view of a display carton, with detachable cover panel and containers removed, in accordance herewith;

DETAILED DESCRIPTION

Figure 4:
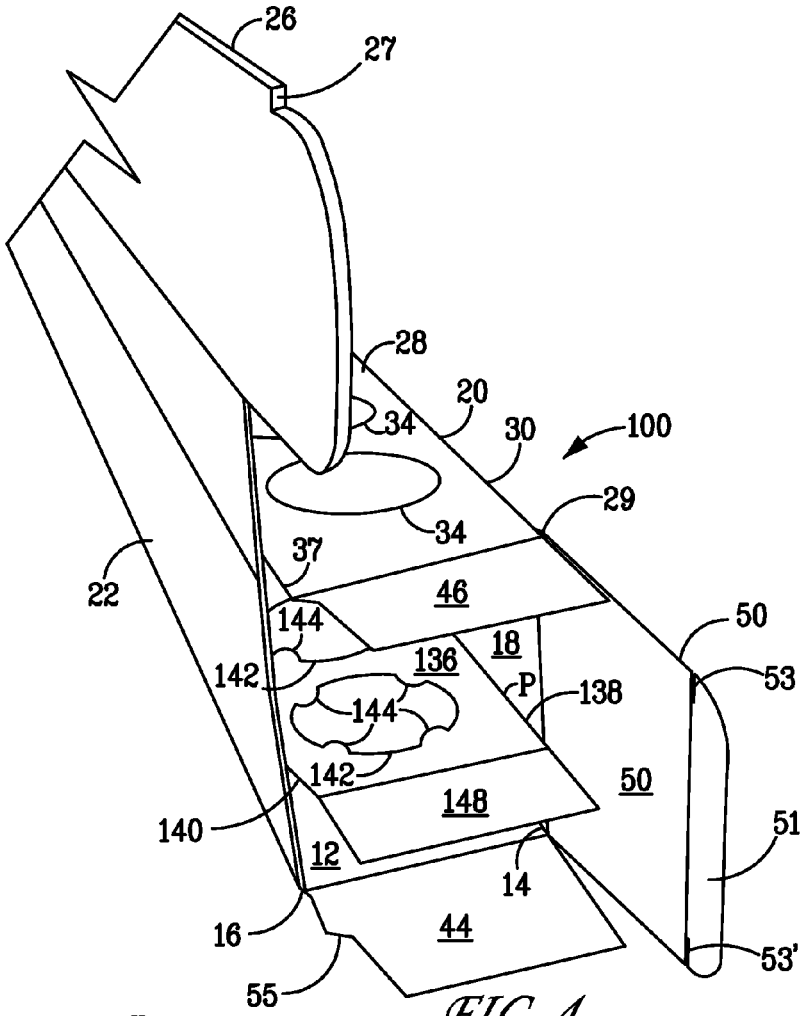
FIG. 4 is a partial perspective view of a partially formed display carton, showing an alternate lower tray configuration, in accordance herewith.
Figure 4B:
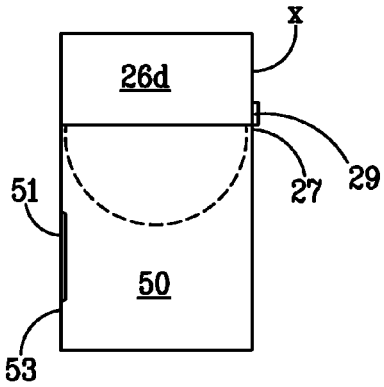
FIG. 4B is an end view of the display carton of FIG. 4 in a fully closed position.

Various aspects will now be described with reference to specific forms selected for purposes of illustration. It will be appreciated that the spirit and scope of the packages and methods disclosed herein are not limited to the selected forms. Moreover, it is to be noted that the figures provided herein are not drawn to any particular proportion or scale, and that many variations can be made to the illustrated forms. Reference is now made to FIGS. 1-12, wherein like numerals are used to designate like elements throughout.

Referring to FIGS. 1-3, one form of a display carton 10 for displaying a plurality of containers is shown. Display carton 10 includes a base 12 having a front edge 14, and a back edge 16. Display carton 10 includes a front side member 18 extending perpendicularly from front edge 14 of base 12 and terminating at an upper edge 20. A rear side member 22 extends perpendicularly from rear edge 16 of base 12 and terminates at an upper edge 24. As shown, rear side member 22 includes cover panel 26 detachably affixed to rear side member 22.

Figure 5:
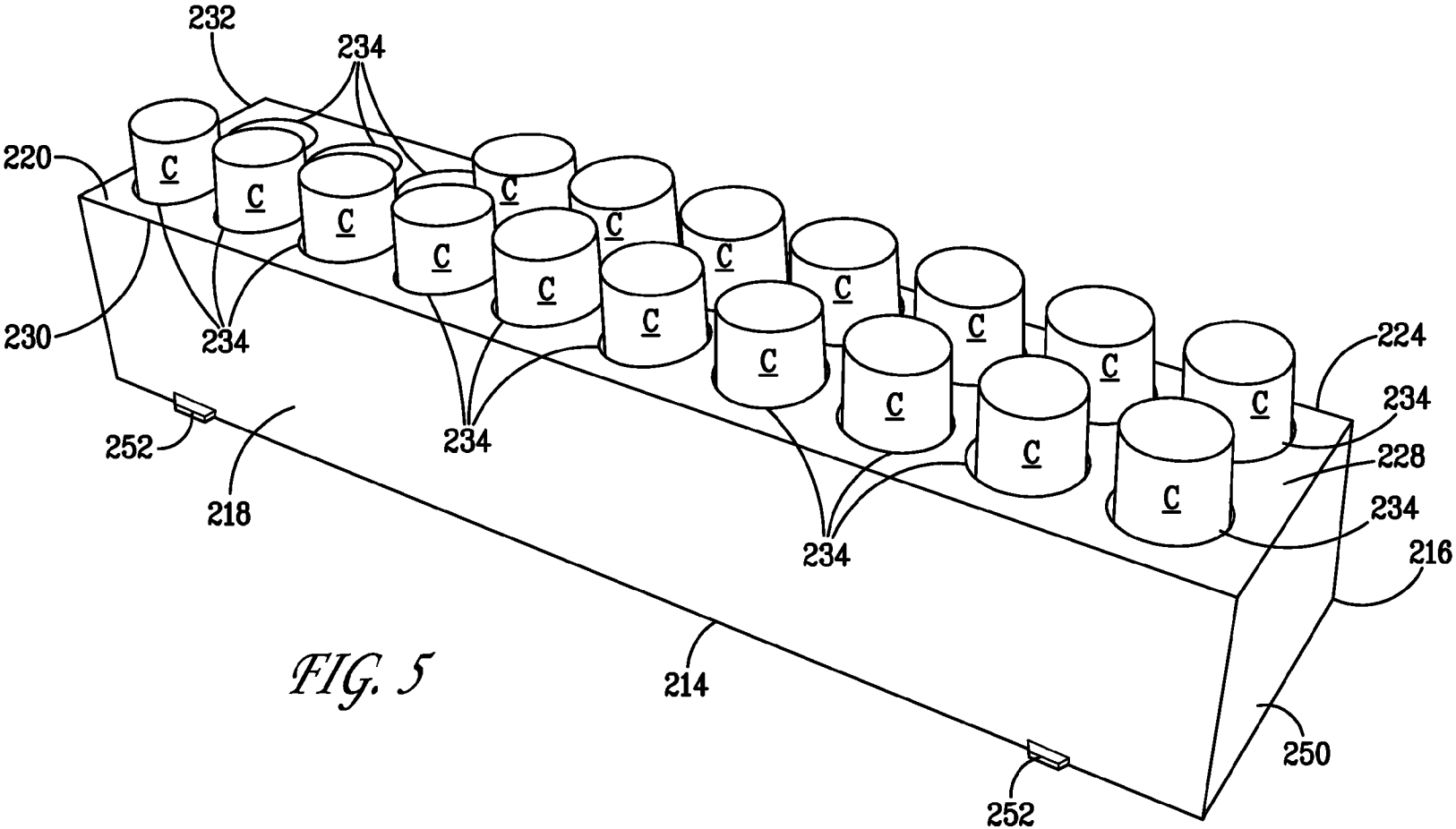
FIG. 5 is a perspective view of a dual row display container, with detachable cover panel removed, in accordance herewith.

Also referring to FIG. 5, in order to store a plurality of containers C, an upper tray member 28 is provided. Upper tray member 28 includes a front edge 30, and a back edge 32. Front edge 30 of upper tray member 28 extends perpendicularly from upper edge 20 of front side member 18. As shown, upper tray member 28 has a plurality of first apertures 34.

To retain and support the plurality of containers C, a lower tray member 36 is provided. Lower tray member 36 includes a front edge 38 and a back edge 40 and is positioned along a plane P. As may be seen, plane P is substantially parallel to upper tray member 24 and base 12 and located therebetween. Lower tray member 36 is provided with a plurality of second apertures 42, each of the plurality of second apertures 42 are provided so as to be in axial alignment with a corresponding first aperture of the plurality of first apertures 34.

As shown in FIGS. 1 and 2, detachable cover panel 26 is configured to fold over and enclose the plurality of containers C when containers C are inserted through corresponding first and second apertures 34 and 42, respectively. Additionally, detachable cover panel 26 may be configured, as shown, to cover at least a portion of front side member 18. In one form, detachable cover panel 26 fully covers front side member 18 and may be sealed by an adhesive tape, label or stamp 901 which extends over to base 12.

To partially close the ends of display carton 10, each end of base 12 and each end of upper tray member 28 are provided with inwardly foldable end flaps 44 and 46, respectively. Lower tray member 36 also is provided with downwardly foldable flaps 48, which also provided additional structural integrity due to the fact they extend fully and contact base 12 when folded.

To fully close the ends of display carton 10, each end of front side member 18 is provided with foldable end flaps 50 for engaging with foldable end flaps 44 of base 12 and foldable end flaps 46 of upper tray member 28 for closure of the display carton 10. As shown in FIGS. 2 and 3, each foldable end flap 50 of front side member 18 serves to form an end member 52. As may be appreciated, to fully close the ends of display carton 10, each end of rear side member 22 could be provided with foldable end flaps (not shown) for engaging with foldable end flaps 44 of base 12 and foldable end flaps 46 of upper tray member 28 for closure of the display carton 10.

Figure 8:
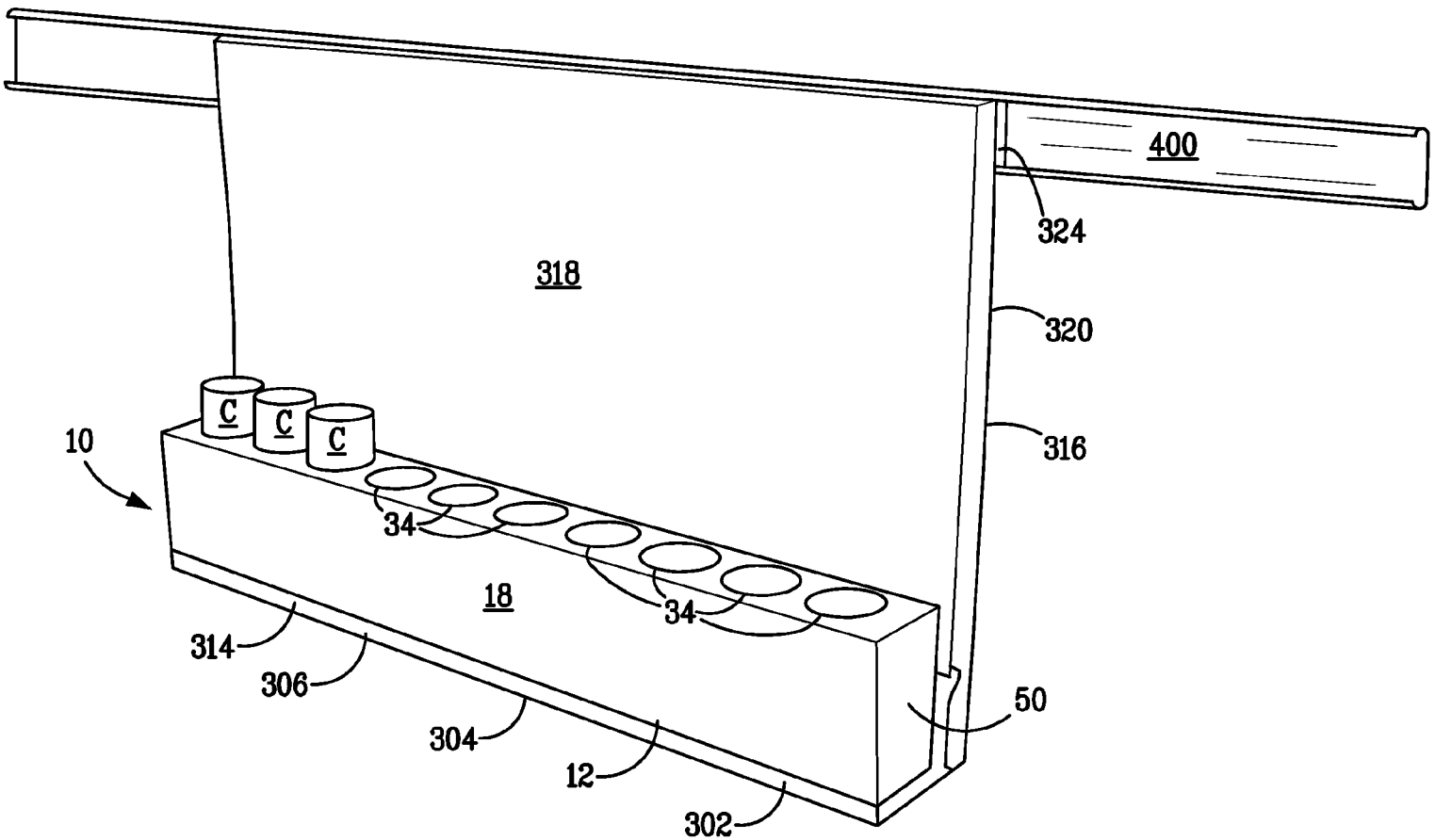
FIG. 8 is a perspective view of a system for the point-of-sale display of a plurality of containers, shown installed on a point-of-sale display rack, in accordance herewith.
Figure 9:
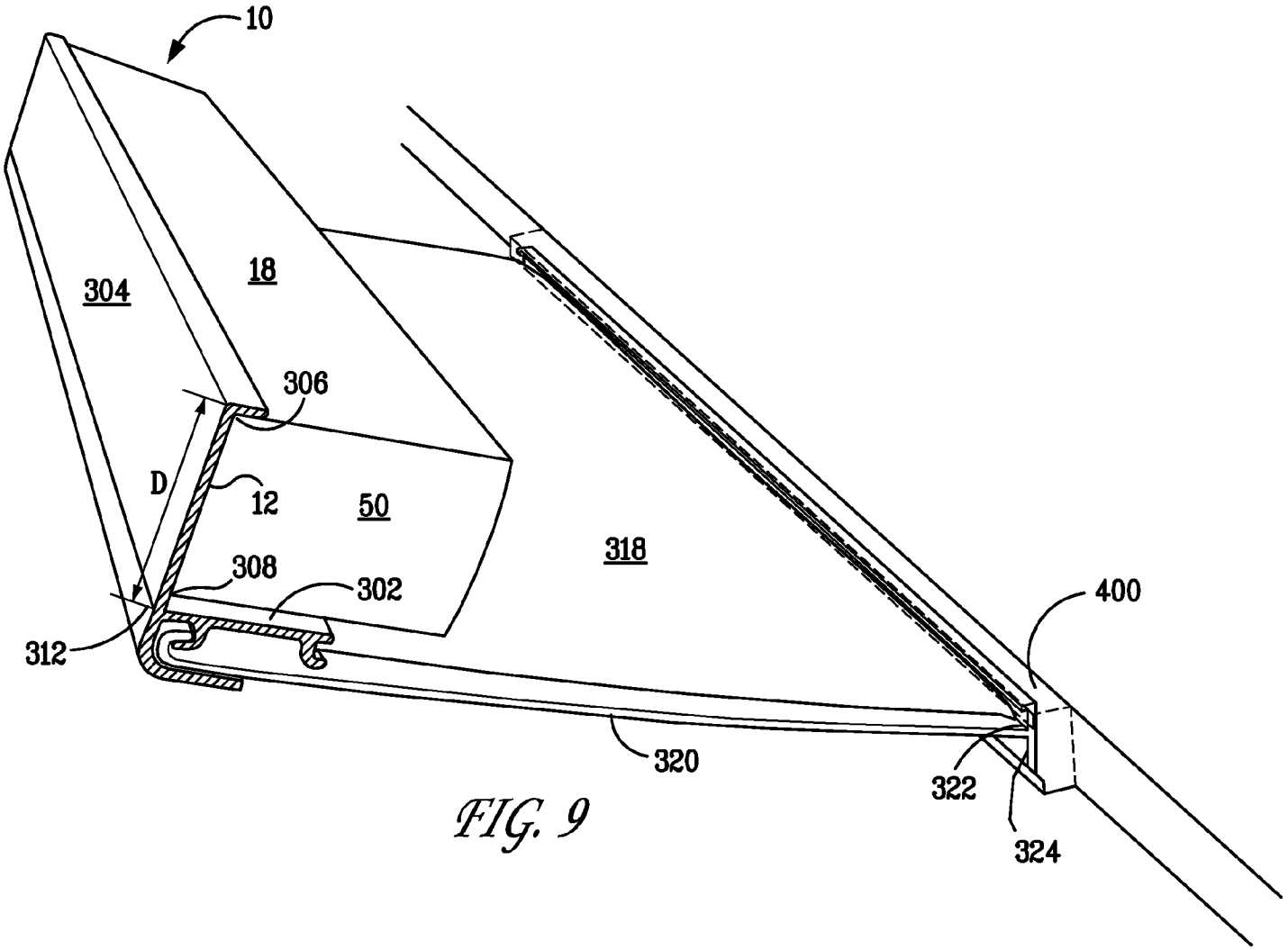
FIG. 9 is a of a system for the point-of-sale display of a plurality of containers, shown installed on a point-of-sale display rack and lifter about its hinge so as to permit the viewing of the products displayed behind the system.

As shown in FIG. 8, display carton 10 is can hold a plurality of containers C by positioning them through a first aperture 34 of upper tray member 28 and a corresponding second aperture 42 of lower tray member 36. When displaying tubular containers, such as those shown in FIGS. 7-9, the plurality of first apertures 34 of upper tray member and the plurality of second apertures 42 of lower tray member 36 are substantially circular.

As shown in FIGS. 2 and 3, in one form, front side member 18 includes a pair of retention cuts 52 adjacent front edge 14 of base 12. Advantageously, retention cuts 52 effectively aid in the registration of detachable cover panel 26, enhancing the rectangularity of display carton 10. As will be described hereinbelow, when detachable cover panel 26 of display carton 10 is removed and the carton inserted in an elongated support rail for display, the pair of retention cuts 52 serve to securely retain display carton 10 therein. While a pair of retention cuts 52 has been shown, any number may be employed and are within the scope of the present invention.

In one form, in order to yield a more attractive display, detachable cover panel 26 may be provided with a set of perforations 54 to permit detachment, the set of perforations 54 extending along a line L positioned below upper edge 24 of rear side member 22.

Referring now to FIG. 4, display carton 100 is shown and provided with another form of lower tray member, lower tray member 136. Lower tray member 136 includes a front edge 138 and a back edge 140 and is positioned along a plane P. As may be seen, plane P is substantially parallel to upper tray member 24 and base 12 and located therebetween. Lower tray member 136 is provided with a plurality of second apertures 142, each of the plurality of second apertures 142 are provided so as to be in axial alignment with a corresponding first aperture of the plurality of first apertures 34. To aid in securing containers C (not shown), each of the plurality of second apertures 142 are provided with tabs 144, for interferingly retaining containers C within the plurality of second apertures 142.

Figure 6:
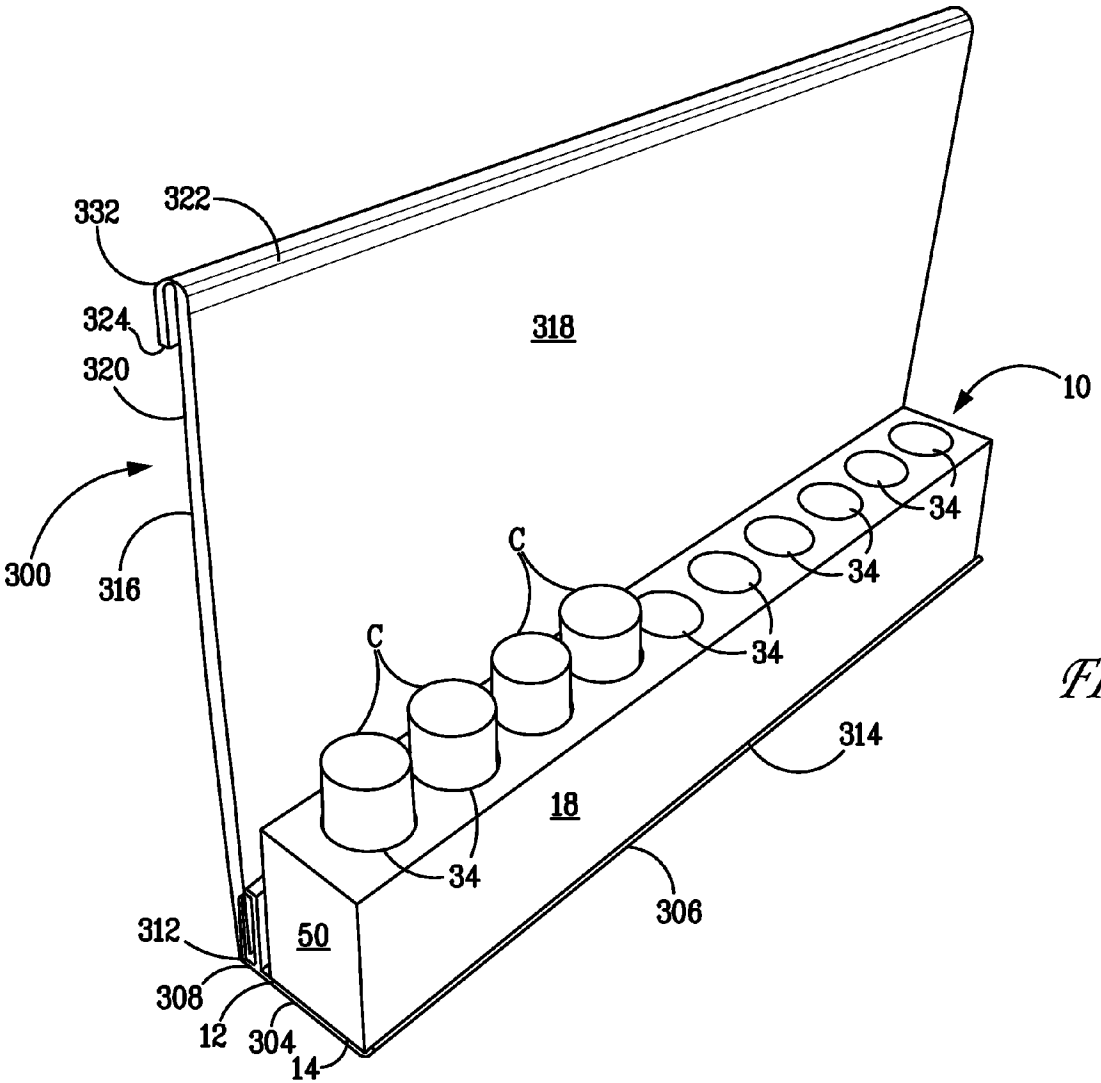
FIG. 6 is a perspective view of a system for the point-of-sale display of a plurality of containers, in accordance herewith.
Figure 7:
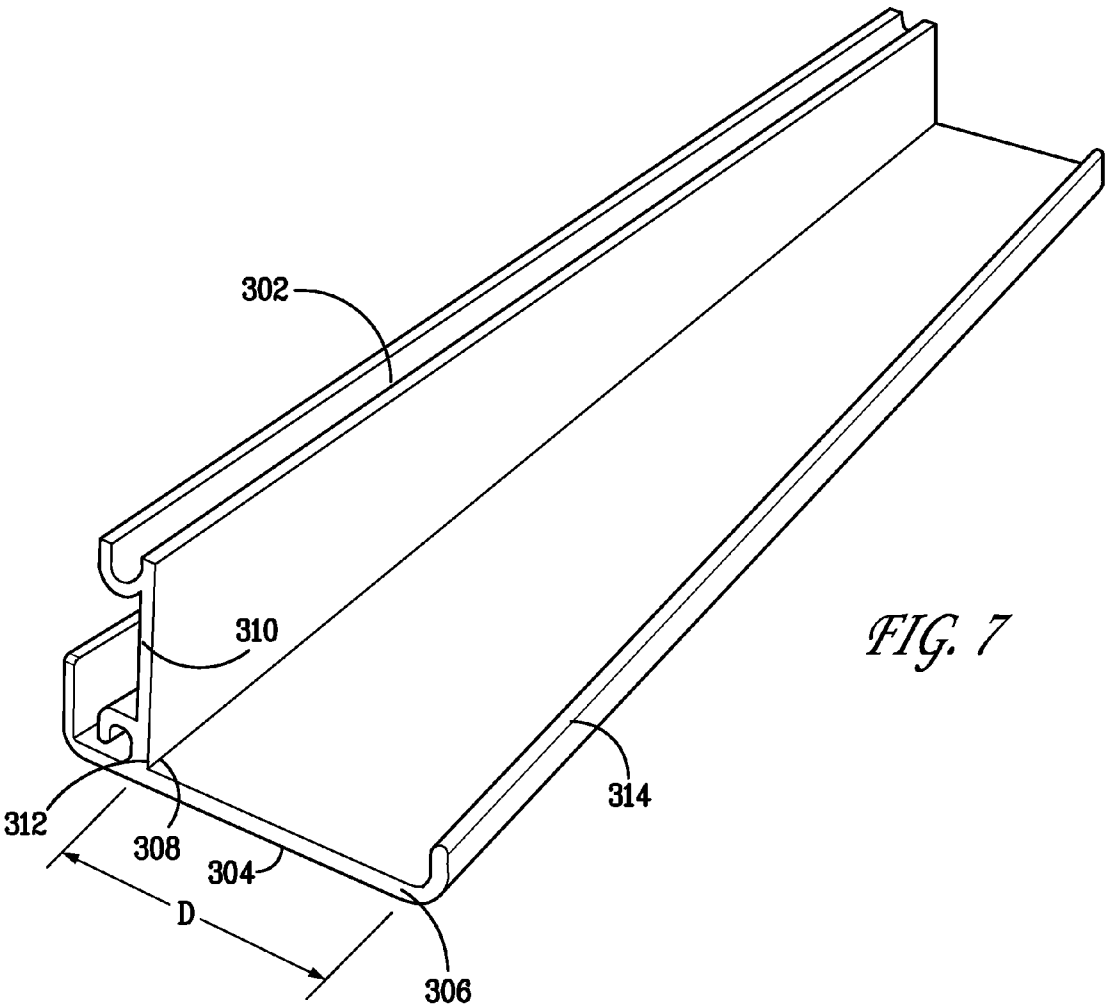
FIG. 7 is a perspective view of an elongated support rail for supporting the base of a display carton, in accordance herewith.

Referring to FIG. 6, another form of a display carton 200 for displaying a plurality of containers C is shown. Display carton 200 includes a base 212 having a front edge 214, and a back edge 216. Display carton 200 includes a front side member 218 extending perpendicularly from front edge 214 of base 212 and terminating at an upper edge 220. A rear side member (not shown) extends perpendicularly from rear edge 216 of base 212 and terminates at an upper edge 224. As with the form depicted in FIGS. 1-3, rear side member includes a cover panel (detached), which is detachably affixed to the rear side member.

In order to store a plurality of containers C, an upper tray member 228 is provided. Upper tray member 228 includes a front edge 230, and a back edge 232. Front edge 230 of upper tray member 228 extends perpendicularly from upper edge 224 of front side member 218. As shown, upper tray member 228 has a plurality of first apertures 234, arranged in two rows.

As with the form depicted in FIGS. 1-3, to retain and support the plurality of containers C, a lower tray member (not shown) is provided. The lower tray member is provided with a plurality of second apertures (not shown), each of the plurality of second apertures provided so as to be in axial alignment with a corresponding first aperture of the plurality of first apertures 234.

As with the form depicted in FIGS. 1-3, detachable cover panel (not shown) is configured to fold over and enclose the plurality of containers C when containers C are inserted through corresponding first and second apertures. Additionally, the detachable cover panel may be configured to cover at least a portion of front side member 218. In one form, the detachable cover panel fully covers front side member 218 and may be sealed by an adhesive tape, label or stamp which extends over to base 212.

As with the form depicted in FIGS. 1-3, to partially close the ends of display carton 200, each end of base 212 and each end of upper tray member 228 are provided with inwardly foldable end flaps (not shown). Lower tray member (not shown) also is provided with downwardly foldable flaps (not shown), which also provided additional structural integrity due to the fact they extend fully and contact base 212 when folded.

To fully close the ends of display carton 200, each end of front side member 218 is provided with foldable end flaps 250 for engaging with foldable end flaps (not shown) of base 212 and foldable end flaps (not shown) of upper tray member 228 for closure of the display carton 200. Each foldable end flap 250 of front side member 218 serves to form an end member 252. As may be appreciated, to fully close the ends of display carton 200, each end of rear side member could be provided with foldable end flaps for engaging with foldable end flaps of base 212 and foldable end flaps of upper tray member 228 for closure of the display carton 200.

As shown in FIG. 6, display carton 200 can hold a plurality of containers C by positioning them through a first aperture 234 of upper tray member 228 and a corresponding second aperture (not shown) of lower tray member (not shown).

As shown, in one form, front side member 218 includes a pair of retention cuts 252 adjacent front edge 214 of base 212. Advantageously, retention cuts 252 effectively aid in the registration of detachable cover panel (not shown), enhancing the rectangularity of display carton 200. As mentioned and will be described hereinbelow, the pair of retention cuts 252 also serve to securely retain display carton 200 within an elongated support rail. While a pair of retention cuts 252 has been shown, any number may be employed and are within the scope of the present invention.

Referring now to FIGS. 6-9, in another aspect, a system 300 for displaying a plurality of containers C in cooperation with a point of sale display rack 400 is provided.

In one form and, and also with reference to FIGS. 1-3, system 300 a display carton 10 with a base 12 having a front edge 14, and a back edge 16. Display carton 10 includes a front side member 18 extending perpendicularly from front edge 14 of base 12 and terminating at an upper edge 20. A rear side member 22 extends perpendicularly from rear edge 16 of base 12 and terminates at an upper edge 24. As shown, rear side member 22 includes cover panel 26 detachably affixed to rear side member 22.

As shown in FIG. 6, in order to store a plurality of containers C, an upper tray member 28 is provided. Upper tray member 28 includes a front edge 30, and a back edge 32. Front edge 30 of upper tray member 28 extends perpendicularly from upper edge 24 of front side member 18. As shown, upper tray member 28 has a plurality of first apertures 34.

To retain and support the plurality of containers C, a lower tray member 36 is provided. Lower tray member 36 includes a front edge 38 and a back edge 40 and is positioned along a plane P. As may be seen, plane P is substantially parallel to upper tray member 24 and base 12 and located therebetween. Lower tray member 36 is provided with a plurality of second apertures 42, each of the plurality of second apertures 42 are provided so as to be in axial alignment with a corresponding first aperture of the plurality of first apertures 34.

As shown in FIGS. 1 and 2, detachable cover panel 26 is configured to fold over and enclose the plurality of containers C when containers C are inserted through corresponding first and second apertures 34 and 42, respectively. Additionally, detachable cover panel 26 may be configured, as shown, to cover at least a portion of front side member 18. In one form, detachable cover panel 26 fully covers front side member 18 and may be sealed by an adhesive tape, label or stamp which extends over to base 12.

To partially close the ends of display carton 10, each end of base 12 and each end of upper tray member 28 are provided with inwardly foldable end flaps 44 and 46, respectively. Lower tray member 36 also is provided with downwardly foldable flaps 48, which also provided additional structural integrity due to the fact they extend fully and contact base 12 when folded.

To fully close the ends of display carton 10, each end of front side member 18 is provided with foldable end flaps 50 for engaging with foldable end flaps 44 of base 12 and foldable end flaps 46 of upper tray member 28 for closure of the display carton 10. As shown in FIGS. 2 and 3, each foldable end flap 50 of front side member 18 serves to form an end member 52. As may be appreciated, to fully close the ends of display carton 10, each end of rear side member 22 could be provided with foldable end flaps (not shown) for engaging with foldable end flaps 44 of base 12 and foldable end flaps 46 of upper tray member 28 for closure of the display carton 10.

As shown in FIG. 8, display carton 10 is can hold a plurality of containers C by positioning them through a first aperture 34 of upper tray member 28 and a corresponding second aperture 42 of lower tray member 36. When displaying tubular containers, such as those shown in FIGS. 6, 8 and 9, the plurality of first apertures 34 of upper tray member and the plurality of second apertures 42 of lower tray member 36 are substantially circular.

As shown in FIGS. 2 and 3, in one form, front side member 18 includes a pair of retention cuts 52 adjacent front edge 14 of base 12. Advantageously, retention cuts 52 effectively aid in the registration of detachable cover panel 26, enhancing the rectangularity of display carton 10. As will be described hereinbelow, when detachable cover panel 26 of display carton 10 is removed and the carton inserted in an elongated support rail for display, the pair of retention cuts 52 serve to securely retain display carton 10 therein. While a pair of retention cuts 52 has been shown, any number may be employed and are within the scope of the present invention.

In one form, in order to yield a more attractive display, detachable cover panel 26 may be provided with a set of perforations 54 to permit detachment, the set of perforations 52 extending along a line L positioned below upper edge 24 of rear side member 22.

Referring again to FIGS. 6-9, system 300 also includes an elongated support rail 302 comprising a bottom rail portion 304 for supporting base 12 of display carton 10. Bottom rail portion 304 has a front edge 306 and a rear edge 308. Elongated support rail 302 also includes a back rail portion 310 for supporting rear side member 22 of display carton 10. In one form, back rail portion 310 has a lower edge 312, integrally formed and adjacent to rear edge 308 of bottom rail portion 304.

As mentioned above, display 10 may be provided with a front side member 18 that includes a pair of retention cuts 52 adjacent the front edge 14 of base 12, the retention cuts 52 effective to aid in the registration of detachable cover panel 26 when the display carton 10 is in the closed position.

In one form, of system 300, front edge 306 of bottom rail portion 304 of elongated support rail 302 terminates in an upwardly extending lip 314 for engaging the pair of retention cuts 52 of front side member 18 of display carton 10. Advantageously, the distance D between upwardly extending lip 314 and back rail portion 310 of elongated support rail 302 is selected to securely retain display carton 10 when the pair of retention cuts 52 of front side member 18 of display carton 10 are engaged and in contact with upwardly extending lip 314.

In one form, system 300 also includes a point-of-sale message board 316 having a front side 318 for displaying a message thereon and a rear side 320, the message board having an upper edge 322 terminating in a downwardly extending and rear-side-facing retaining flange 324, and a lower edge terminating 326 in an upwardly extending and front-side-facing locking member 328. In one form, rear-side-facing retaining flange 324 is configured to securely attach to a horizontal member of the point of sale display rack 400 (see FIG. 9).

In one form, point-of-sale message board 316 of system 300 is provided with a rear-side-facing retaining flange 324 that is mounted to hinge 332 to upper edge 322 of message board 316. In this form, such a message board 316 is also referred to as a flip sign, since it may be flipped or pivoted upwards to expose product that may be stored behind message board 316. Referring in particularly to FIGS. 5 and 6, in one form, elongated support rail 302 is provided with a channel 330 for receiving front-side-facing locking member 328 of point-of-sale message board 316.

As may be appreciated, when display carton 10 is made ready for display by removing detachable cover panel 26, by severing same through the use of the set of perforations 52 to permit detachment, were the set of perforations 52 to extend along a line positioned at or above the upper edge 24 of rear side member 22, a rough or ragged edge would be exposed to customers. Therefore, in one form, in order to yield a more attractive display, detachable cover panel 26 is provided with a set of perforations 54 to permit detachment, the set of perforations 52 extending along a line L positioned below upper edge 24 of rear side member 22.

In one form, provided is a method of forming a display carton from a sheet of stock. The method includes the steps of cutting the sheet of stock into a size and shape sufficient to form a substrate having a plurality of panels; folding the substrate to form a display carton for displaying a plurality of containers, the display carton including a base having a front edge, and a back edge; a front side member extending perpendicularly from the front edge of the base and terminating at an upper edge thereof; a rear side member extending perpendicularly from the rear edge of the base and terminating at an upper edge thereof, the rear side member having a cover panel detachably affixed to the rear side member; an upper tray member having a front edge, and a back edge, the front edge extending perpendicularly from the upper edge of the front side member; and a lower tray member, the lower tray member positioned along a plane substantially parallel to the upper tray member and the base and located therebetween, the lower tray member having a plurality of second apertures, each of the plurality of second apertures in axial alignment with a corresponding first aperture of the plurality of first apertures; adhesively securing a front edge flap of the lower tray member to an inner side of the front side member; wherein the detachable cover panel is configured to fold over and enclose the plurality of containers when inserted through corresponding first and second apertures and cover at least a portion of the front side member for sealing the detachable cover panel thereto.

Figure 10:
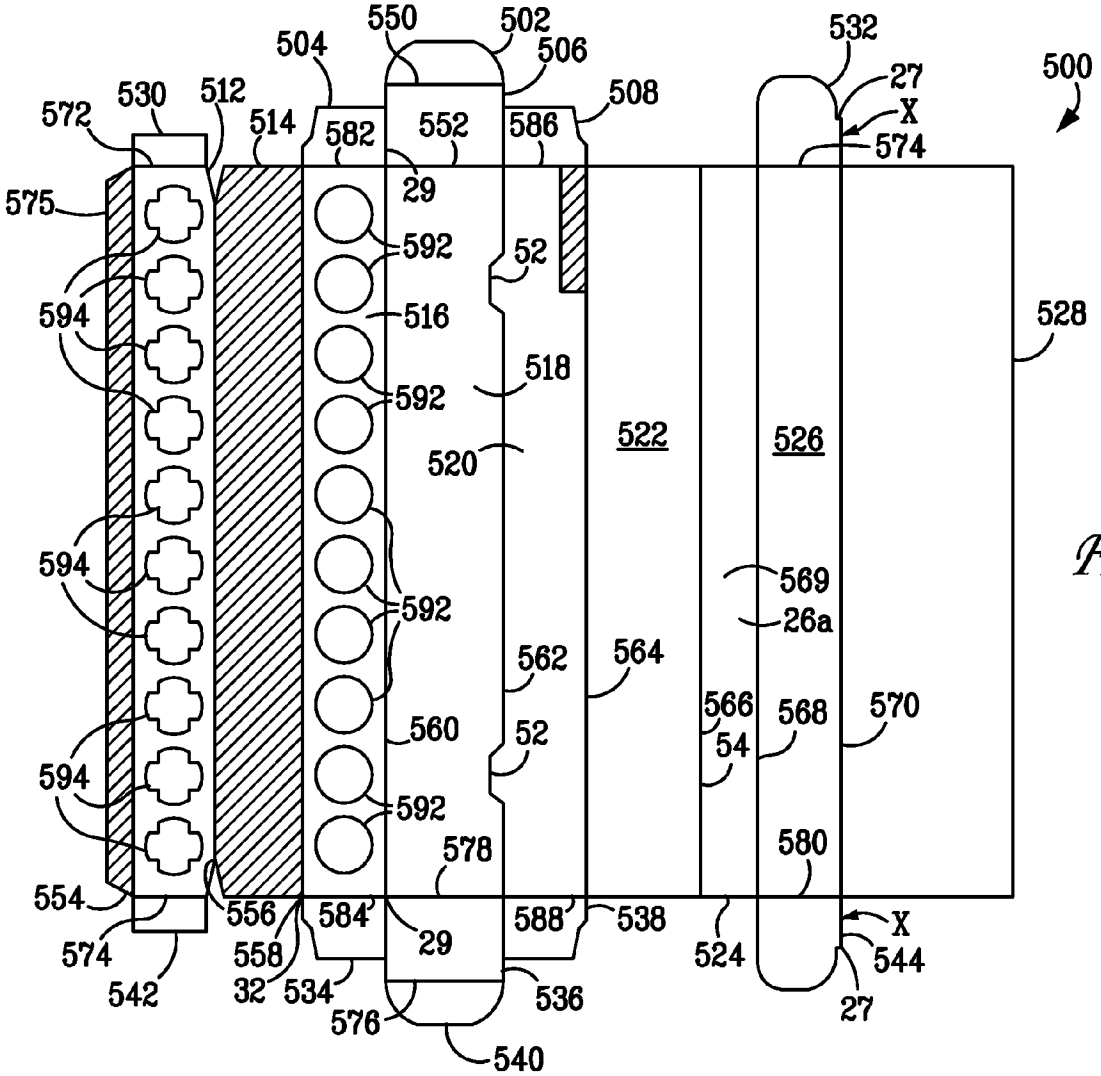
FIG. 10 depicts a lay flat view of a substrate for use in forming a display carton, in accordance herewith.

Referring now to FIG. 10, a substrate 500 may be formed from a single cut sheet of stock and folded as will be described to form the display cartons disclosed herein. As shown, a plurality of panels (502-544) is formed via a plurality of score lines (550-588).

To form a display carton of the type disclosed herein, panel 510 is downwardly folded along score line 554. Lower tray panel 512 is upwardly folded along score line 556, with panel 514 upwardly folded along score line 558. Next, upper tray panel 516 is upwardly folded along score line 560 and front side panel 518 is upwardly folded along score line 562. Base panel 520 is upwardly folded along score line 562 and rear side panel 522 is upwardly folded along score line 564. Panel 510 is adhesively secured to an interior surface of front side panel 518, forming the basic structure of the display carton.

Placing the carton on its base, end panels 530 and 542 of lower tray panel 512 are downwardly folded along score lines 572 and 574, respectively, contacting an interior surface of base panel 520. End flap panels 504 and 534 of upper tray panel 516 are downwardly folded along score lines 582 and 584, and end flap panels 508 and 538 of base panel 520 are upwardly folded along score lines 586 and 588. End cover panels 506 and 536 are folded along score lines 552 and 578, respectively. Finally, locking flaps 502 and 540 are folded along score lines 550 and 576, respectively for inserting and locking end cover panels 506 and 536 in place.

Upon placing containers through apertures 592 and 594 of upper tray panel 516 and lower tray panel 512, tuck flaps 532 and 544 are folded along score lines 574 and 580, respectively, detachable panel cover portion 526 is folded along score line 568, tuck flaps 532 and 544 are tucked into end cover panels 506 and 536, respectively, and detachable panel cover portion 528 is folded along score line 570 and may be sealed to base panel 520 to seal the display carton. As shown, to aid in securing containers C (not shown), each of the plurality of apertures 594 are provided with tabs, for interferingly retaining containers C within the plurality of apertures 594.

Figure 11:
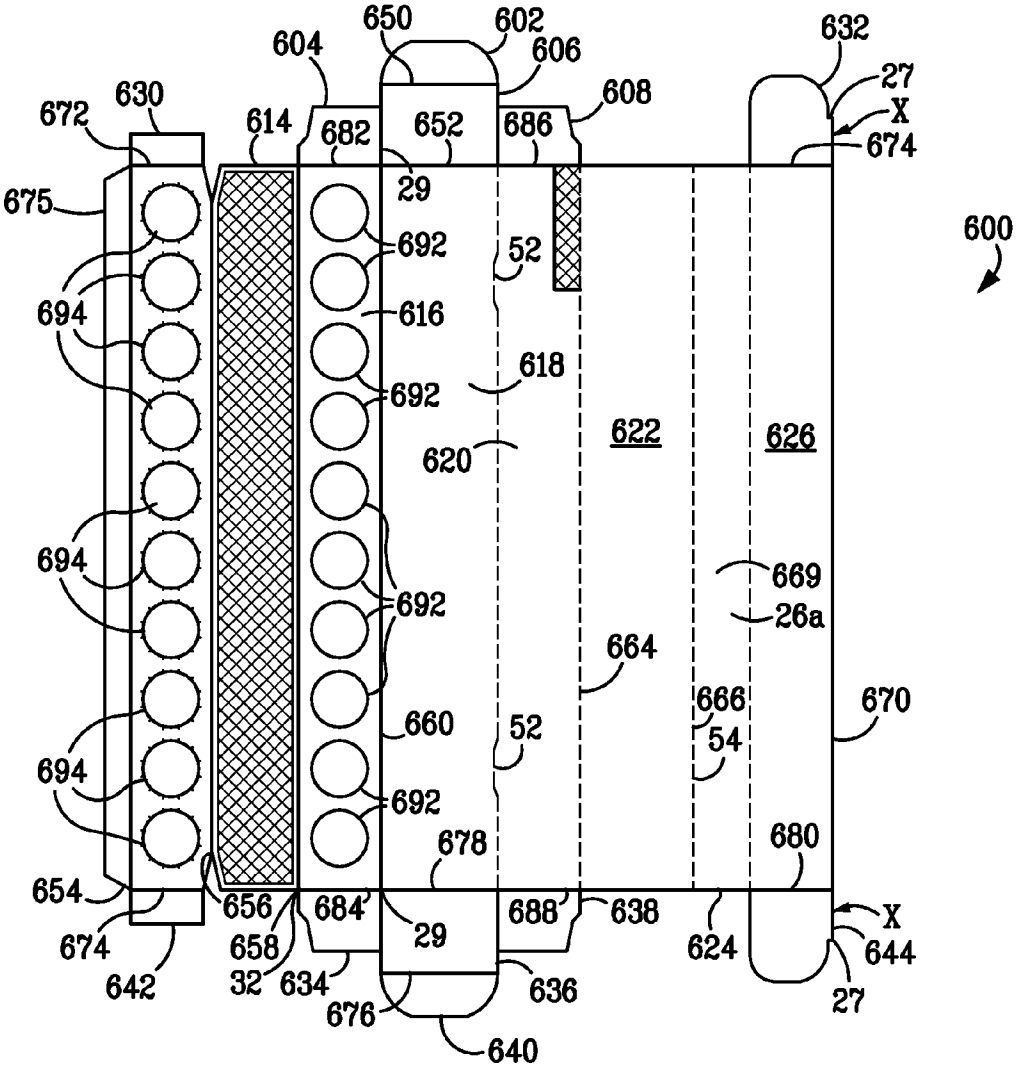
FIG. 11 depicts a lay flat view of another substrate for use in forming a display carton, also in accordance herewith.

Referring now to FIG. 11, a substrate 600 may be formed from a single cut sheet of stock and folded as will be described to form a variation of the display cartons disclosed herein. As shown, a plurality of panels (602-644) is formed via a plurality of score lines (650-688).

To form the display carton of FIG. 11, panel 610 is downwardly folded along score line 654. Lower tray panel 612 is upwardly folded along score line 656, with panel 614 upwardly folded along score line 658. Next, upper tray panel 616 is upwardly folded along score line 660 and front side panel 618 is upwardly folded along score line 662. Base panel 620 is upwardly folded along score line 662 and rear side panel 622 is upwardly folded along score line 664. Panel 610 is adhesively secured to an interior surface of front side panel 618, forming the basic structure of the display carton.

Placing the carton on its base, end panels 630 and 642 of lower tray panel 612 are downwardly folded along score lines 672 and 674, respectively, contacting an interior surface of base panel 620. End flap panels 604 and 634 of upper tray panel 616 are downwardly folded along score lines 682 and 684, and end flap panels 608 and 638 of base panel 620 are upwardly folded along score lines 686 and 688. End cover panels 606 and 636 are folded along score lines 652 and 678, respectively. Finally, locking flaps 602 and 640 are folded along score lines 650 and 676, respectively for inserting and locking end cover panels 606 and 636 in place.

Upon placing containers through apertures 692 and 694 of upper tray panel 616 and lower tray panel 612, tuck flaps 632 and 644 are folded along score lines 674 and 680, respectively, detachable panel cover portion 626 is folded along score line 668, tuck flaps 632 and 644 are tucked into end cover panels 606 and 636, respectively. As shown, to aid in securing containers C (not shown), each of the plurality of apertures 694 may be slightly undersized with respect to containers C are provided with a plurality of relief slits, for interferingly retaining containers C within the plurality of apertures 694.

Figure 12:
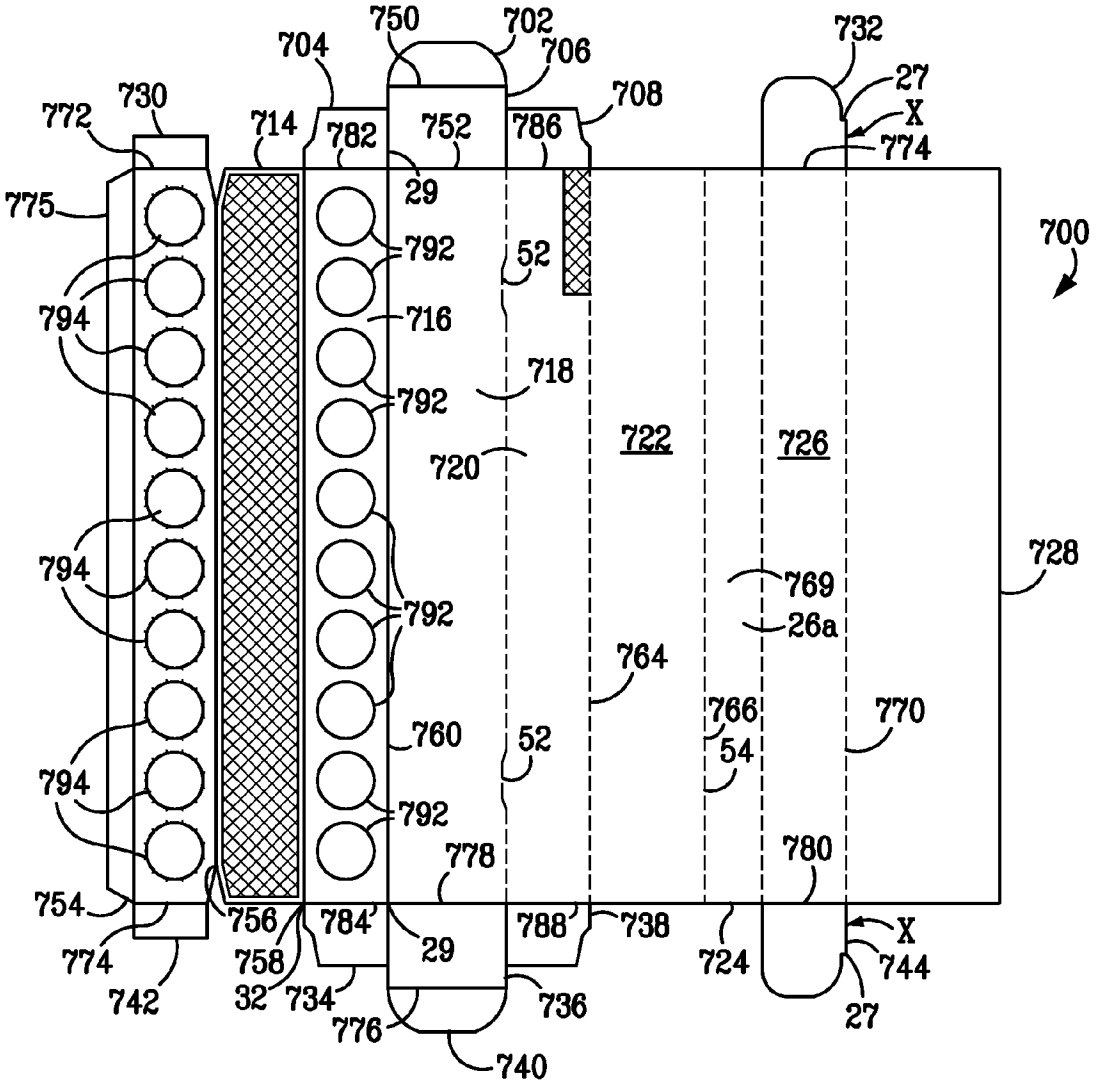
FIG. 12 depicts a lay flat view of a yet another substrate for use in forming a display carton, also in accordance herewith.

With reference now to FIG. 12, a substrate 700 may be formed from a single cut sheet of stock and folded as will be described to form the display cartons disclosed herein. As shown, a plurality of panels (702-744) is formed via a plurality of score lines (750-788).

To form a display carton of the type disclosed herein, panel 710 is downwardly folded along score line 754. Lower tray panel 712 is upwardly folded along score line 756, with panel 714 upwardly folded along score line 758. Next, upper tray panel 716 is upwardly folded along score line 760 and front side panel 718 is upwardly folded along score line 762. Base panel 720 is upwardly folded along score line 762 and rear side panel 722 is upwardly folded along score line 764. Panel 710 is adhesively secured to an interior surface of front side panel 718, forming the basic structure of the display carton.

Placing the carton on its base, end panels 730 and 742 of lower tray panel 712 are downwardly folded along score lines 772 and 774, respectively, contacting an interior surface of base panel 720. End flap panels 704 and 734 of upper tray panel 716 are downwardly folded along score lines 782 and 784, and end flap panels 708 and 738 of base panel 720 are upwardly folded along score lines 786 and 788. End cover panels 706 and 736 are folded along score lines 752 and 778, respectively. Finally, locking flaps 702 and 740 are folded along score lines 750 and 776, respectively for inserting and locking end cover panels 706 and 736 in place.

Upon placing containers through apertures 792 and 794 of upper tray panel 716 and lower tray panel 712, tuck flaps 732 and 744 are folded along score lines 774 and 780, respectively, detachable panel cover portion 726 is folded along score line 768, tuck flaps 732 and 744 are tucked into end cover panels 706 and 736, respectively, and detachable panel cover portion 728 is folded along score line 570 and may be sealed to base panel 720 to seal the display carton. As shown, to aid in securing containers C (not shown), each of the plurality of apertures 794 may be slightly undersized with respect to containers C are provided with a plurality of relief slits, for interferingly retaining containers C within the plurality of apertures 794.

In another form, provided is a method of presenting containers of product for sale. The method includes the steps of sending the containers to a place of sale by arranging the containers in a paperboard tray and protecting the containers with paperboard panels folded about the tray; removing the removable panels at the place of sale and positioning the tray on a rail of a display fixture, the positioning including retaining the tray in place on the rail by bearing a retention cut of the tray with a surface portion of the rail.

Advantageously, the display cartons disclosed herein are designed to be capable of high speed assembly, and employ the attendant machines and processes associated therewith.

The design of the display cartons disclosed herein allows for multiple quantities to be packaged. The forms contemplated include 8, 10, 12, 16, and 20 count packages.

All patents, test procedures, and other documents cited herein, including priority documents, are fully incorporated by reference to the extent such disclosure is not inconsistent with this disclosure and for all jurisdictions in which such incorporation is permitted.

While the illustrative embodiments disclosed herein have been described with particularity, it will be understood that various other modifications will be apparent to and can be readily made by those skilled in the art without departing from the spirit and scope of the disclosure. Accordingly, it is not intended that the scope of the claims appended hereto be limited to the examples and descriptions set forth herein but rather that the claims be construed as encompassing all the features of patentable novelty which reside herein, including all features which would be treated as equivalents thereof by those skilled in the art to which the disclosure pertains.

What is claimed is:

1. A display carton for displaying a plurality of containers, comprising:

a) a base having a front edge, and a back edge;

b) a front side member extending perpendicularly from said front edge of said base and terminating at an upper edge of said front side member;

c) a rear side member extending perpendicularly from said back edge of said base and terminating at an upper edge of said rear side member, said rear side member having a cover panel detachably affixed to said rear side member with a set of perforations to permit detachment, said set of perforations extending along a line positioned below said upper edge of said rear side member;

(d) an upper tray member having a front edge, and a back edge, said front edge extending perpendicularly from said upper edge of said front side member, said upper tray member having a plurality of first apertures; and (e) a lower tray member, said lower tray member positioned along a plane substantially parallel to said upper tray member and said base and located therebetween, said lower tray member having a plurality of second apertures, each of said plurality of second apertures in axial alignment with a corresponding first aperture of said plurality of first apertures;

wherein said detachable cover panel is configured to fold over and enclose the plurality of containers when inserted through corresponding first and second apertures and cover at least a portion of said front side member for sealing said detachable cover panel thereto.

2. The display carton of claim 1, wherein each end of said base and each end of said upper tray member have foldable end flaps.

3. The display carton of claim 2, wherein each end of said front side member has foldable end flaps for engaging with said foldable end flaps of said base and said upper tray member for closure of the display carton, each said foldable end flap of said front side member serving to form an end member.

4. The display carton of claim 2, wherein each of the plurality of containers are positioned within a first aperture of said plurality of first apertures of said upper tray member and a corresponding second aperture of said plurality of second apertures of said lower tray member.

5. The display carton of claim 4, wherein said plurality of first apertures of said upper tray member and said plurality of second apertures of said lower tray member are arranged in at least two rows.

6. The display carton of claim 5, wherein said plurality of first apertures of said upper tray member and said plurality of second apertures of said lower tray member are substantially circular.

7. The display carton of claim 1, wherein said plurality of first apertures of said upper tray member and said plurality of second apertures of said lower tray member are substantially circular.

8. The display carton of claim 1, wherein said front side member includes a pair of retention cuts adjacent said front edge of said base, said pair of retention cuts effective to aid in the registration of said detachable cover panel.

9. The display carton of claim 1, wherein the display carton is formed from a sheet of cardboard stock.

10. The display carton of claim 1, wherein each of the plurality of second apertures are provided with tabs, for interferingly retaining the containers within the plurality of second apertures.

11. The display carton of claim 1, wherein each of the plurality of second apertures are slightly undersized with respect to the containers and each of the plurality of second apertures are provided with a plurality of relief slits, for interferingly retaining the containers within the plurality of second apertures.

12. A display carton for displaying a plurality of containers, comprising:

a) a base having a front edge, and a back edge;

b) a front side member extending perpendicularly from said front edge of said base and terminating at an upper edge of said front side member;

c) a rear side member extending perpendicularly from said back edge of said base and terminating at an upper edge of said rear side member, said rear side member having a cover panel detachably affixed to said rear side member;

(d) an upper tray member having a front edge, and a back edge, said front edge extending perpendicularly from said upper edge of said front side member, said upper tray member having a plurality of first apertures; and (e) a lower tray member, said lower tray member positioned along a plane substantially parallel to said upper tray member and said base and located therebetween, said lower tray member having a plurality of second apertures, each of said plurality of second apertures in axial alignment with a corresponding first aperture of said plurality of first apertures;

wherein said detachable cover panel is configured to fold over and enclose the plurality of containers when inserted through corresponding first and second apertures and cover at least a portion of said front side member for sealing said detachable cover panel thereto, and said front side member includes a pair of retention cuts adjacent said front edge of said base, said pair of retention cuts effective to aid in the registration of said detachable cover panel.

13. The display carton of claim 12, wherein said detachable cover panel includes a set of perforations to permit detachment, said set of perforations extending along a line positioned below said upper edge of rear side member.

14. The display carton of claim 12, further comprising an adhesive element positioned between said pair of retention cuts.

* * * * *